US010465958B2

(12) United States Patent
Boecker et al.

(10) Patent No.: US 10,465,958 B2
(45) Date of Patent: Nov. 5, 2019

(54) METHODS AND SYSTEMS TO REDUCE DAMAGE CAUSED BY VIBRATION

(71) Applicant: TRANE INTERNATIONAL INC., Piscataway, NJ (US)

(72) Inventors: Brad A. Boecker, La Crosse, WI (US); Ferdy Martinus, Onalaska, WI (US); Jyuhn-Jier Jack Wang, Onalaska, WI (US); Eric Curti, La Crosse, WI (US); Mark N. Elliott, Bangor, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 185 days.

(21) Appl. No.: 14/688,665

(22) Filed: Apr. 16, 2015

(65) Prior Publication Data

US 2015/0300683 A1 Oct. 22, 2015

Related U.S. Application Data

(60) Provisional application No. 61/980,121, filed on Apr. 16, 2014.

(51) Int. Cl.

| | |
|---|---|
| ***F24F 1/34*** | (2011.01) |
| ***F25B 49/00*** | (2006.01) |
| ***F24F 1/40*** | (2011.01) |

(52) U.S. Cl.

CPC ..... *F25B 49/005* (2013.01); *F24F 1/34* (2013.01); *F24F 1/40* (2013.01); *F25B 2500/13* (2013.01)

(58) Field of Classification Search

CPC ..... F25B 49/005; F25B 2500/13; F24F 1/34; F24F 1/40

See application file for complete search history.

(56) References Cited

U.S. PATENT DOCUMENTS

| | | | | |
|---|---|---|---|---|
| 2,395,144 | A | 2/1946 | Stivason | |
| 3,088,294 | A | 5/1963 | Smith | |
| 3,134,611 | A | 5/1964 | Iversen | |
| H1317 | H | 6/1994 | Ng | |
| 6,079,674 | A | 6/2000 | Snyder | |
| 6,655,165 | B1 * | 12/2003 | Eisenhour | F25B 41/06 181/224 |
| 6,775,593 | B1 * | 8/2004 | Parker | F16K 37/0075 137/624.11 |
| 7,131,287 | B2 | 11/2006 | Uselton | |
| 7,137,268 | B2 | 11/2006 | Cook et al. | |
| 7,281,689 | B1 * | 10/2007 | Johnston | F16L 3/13 248/49 |

(Continued)

FOREIGN PATENT DOCUMENTS

JP 11-304294 * 11/1999

*Primary Examiner* — Filip Zec

(74) *Attorney, Agent, or Firm* — Hamre, Schumann, Mueller & Larson, P.C.

(57) ABSTRACT

Methods, systems and apparatuses configured to isolate and/or damp vibration of refrigerant lines caused by, for example, the compressor are disclosed. A vibration control device can be configured hold a refrigerant line at a position that is away from the compressor. The vibration control device can help isolate the vibration, reducing or preventing the vibration from passing the vibration control device along the refrigerant line. A vibration-damping device can be configured to engage the refrigerant line so as to absorb/damp the vibration of the refrigerant line.

12 Claims, 4 Drawing Sheets

(56) References Cited

U.S. PATENT DOCUMENTS

| | | | | |
|---|---|---|---|---|
| 7,717,135 | B2 | 5/2010 | Chen et al. | |
| 9,285,071 | B1 * | 3/2016 | Rowland | F16M 13/02 |
| 9,702,622 | B2 * | 7/2017 | Park | F25B 41/00 |
| 2005/0183436 | A1 | 8/2005 | Jung et al. | |
| 2012/0117999 | A1 | 5/2012 | Chae et al. | |
| 2013/0312433 | A1 * | 11/2013 | Nemit, Jr. | F24F 1/12 62/56 |

* cited by examiner

METHODS AND SYSTEMS TO REDUCE DAMAGE CAUSED BY VIBRATION

FIELD

This disclosure relates to a heating, ventilation, and air-conditioning ("HVAC") system. More specifically, the disclosure relates to a refrigerant line and methods, systems, and apparatuses directed to reducing vibration caused damage in the refrigerant line of the HVAC system.

BACKGROUND

An HVAC system typically includes a compressor, a condenser, an expansion device, and an evaporator connected by refrigerant lines to form a refrigeration circuit. The compressor of the HVAC system, for example, may produce vibration during operation. The vibration of the compressor may be transmitted to, for example, the refrigerant lines, causing displacement of a refrigerant line. In some situations, the displacement of the refrigerant lines can cause damage (such as line breakage, etc.) to a refrigerant line.

SUMMARY

Embodiments directed to isolate and/or damp vibration of refrigerant lines caused by a vibration source, such as a compressor, in an HVAC system are described. The embodiments disclosed herein can, for example, reduce vibration caused damage to the refrigerant lines.

In some embodiments, a device for damping vibration of a refrigerant line in an HVAC system may include a vibration control device that is configured to engage the refrigerant line. In some embodiments, the device may include a vibration-damping device that is configured to engage the refrigerant line. The vibration-damping device may be positioned between a vibration source and the vibration control device. In some embodiments, the vibration-damping device may include a damping member and a holding device. The damping member may be configured to engage the refrigerant line, and the holding device may be configured to help keep the damping member on the refrigerant line.

In some embodiments, the vibration control device may be rigid so as to prevent vibration from being transmitted across the vibration control device.

In some embodiments, the refrigerant line connecting the compressor and a condenser coil may include a plurality of bends. The vibration control device may be positioned one bend away from the condenser coil. In some embodiments, the vibration-damping device may be at least one bend away from the compressor.

In some embodiments, a method of damping vibration of a refrigerant line may include providing a vibration control position on the refrigerant line; and providing a vibration damping position on the refrigerant line, the vibration damping position may be positioned between a vibration source and the vibration control position. In some embodiments, the vibration control position can provide a reference point for determining a position of the vibration damping position on the refrigerant line. The distance between the vibration control position and the vibration damping position can be configured to shift a resonance frequency of the refrigerant line.

Other features and aspects will become apparent by consideration of the following detailed description and accompanying drawings.

BRIEF DESCRIPTION OF THE DRAWINGS

References are made to the accompanying drawings that form a part hereof, and which illustrate embodiments in which the methods and systems described may be practiced. Like reference numbers represent like parts throughout.

FIG. 2A partially illustrates an HVAC system. FIG. 2B is a sectional view of a refrigerant line covered by a vibration-damping device.

DETAILED DESCRIPTION

Figure 1:
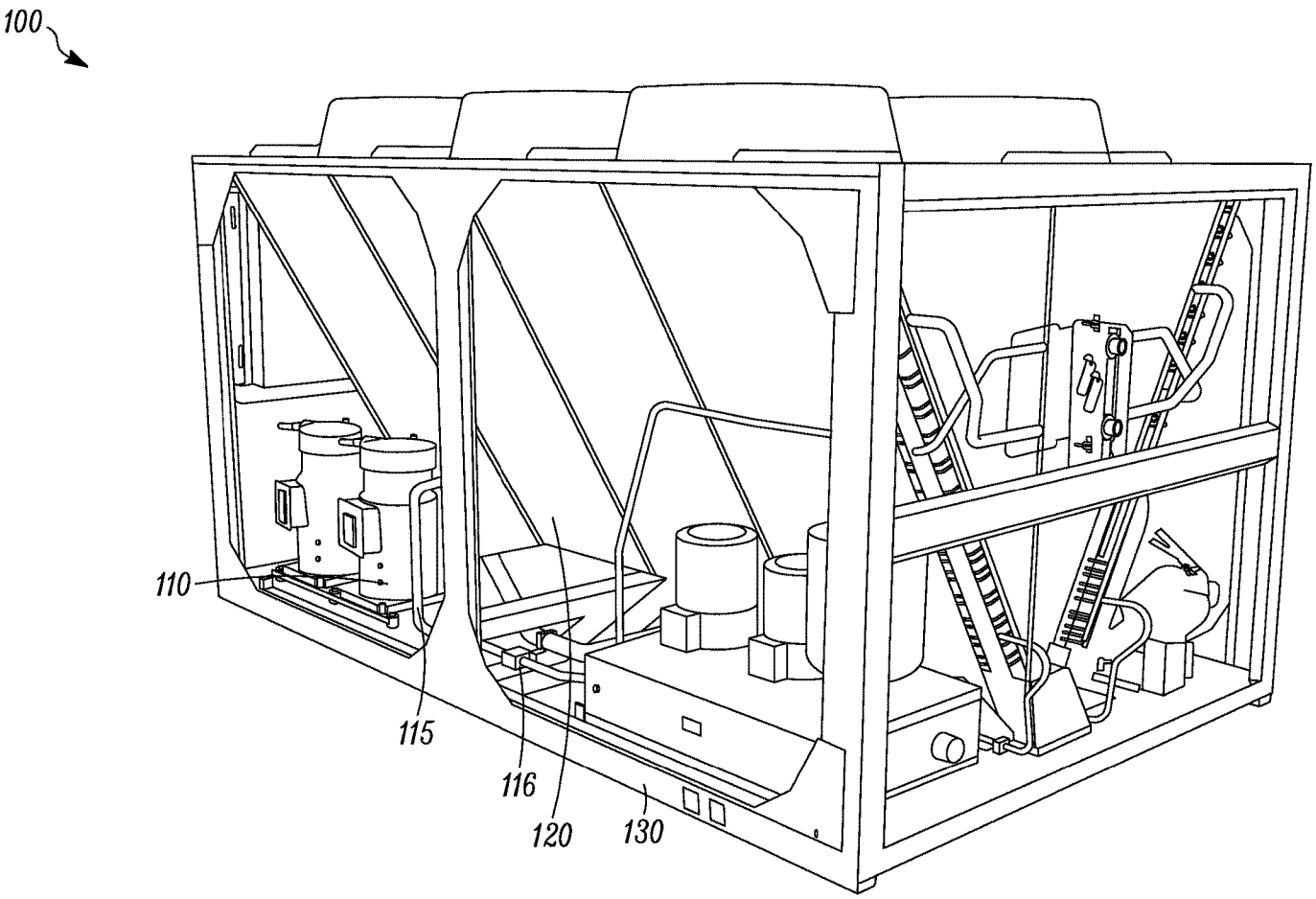
FIG. 1 illustrates an HVAC system with which embodiments as disclosed herein can be practiced.

A compressor of an HVAC system may produce vibration during operation. The vibration of the compressor may be transmitted to refrigerant lines in the HVAC system, which can cause vibration and/or displacement of one or more of the refrigerant lines. The vibration and/or displacement can cause damage to one or more of the refrigerant lines. In some situations, when a frequency of the vibration is at or about a resonance frequency of a refrigerant line, for example, the vibration may also excite the refrigerant line and cause damage to the refrigerant line.

The resonance frequency of the refrigerant line may be changed by, for example, changing a length or other properties of the refrigerant line. Accordingly, the resonance frequency of the refrigerant line can be configured to be different from the vibration frequencies produced by the compressor. For example, in some HVAC systems, the refrigerant line can be configured to be relatively short, so that the resonance frequency of the refrigerant line does not generally overlap with the frequency of the compressor vibration in operation. However, when a variable speed compressor is used, for example, the vibration frequencies of the compressor may have a relatively large range in operation. It may be difficult to make the resonance frequency of the refrigerant line different from the vibration frequencies of the compressor.

The embodiments disclosed herein are directed to methods, systems and apparatuses configured to isolate and/or damp vibration/displacement of refrigerant lines caused by a vibration source, for example, a compressor or the like. In some embodiments, a system to damp the vibration may include a vibration control device (e.g., a clamp, etc.) to hold the refrigerant line at a position that is away from a source of the vibration (e.g., the compressor, etc.). The vibration control device can help isolate the vibration, thereby reducing or preventing the vibration from passing the vibration control device along the refrigerant line. The system may also include a vibration-damping device to damp or absorb the vibration of the refrigerant line. A position of the vibration control device can provide a reference point for a location of the vibration-damping device.

It is to be understood that the terms used in this specification are for the purpose of describing the figures and embodiments and should not be regarded as limiting the scope.

Generally, the terms "upstream" and "downstream," as used in this specification, are relative to refrigerant flow direction in a heat transfer circuit of an HVAC system.

The term "displacement," as used in this specification, is generally referring to movement of the refrigerant line caused by, for example, vibration of the refrigerant line or the like.

The term "rigid," as used in this specification, generally refers to a characteristic of a material or structure that does not vibrate in response to vibrations in an HVAC system (e.g., HVAC system 200 as described in further detail below).

Generally, a method of reducing vibration/displacement of a refrigerant line in an HVAC system may include providing a vibration control position on the refrigerant line. The vibration control position is generally configured to be relatively rigid so that the vibration/displacement of the refrigerant line is generally prevented from being transmitted across the vibration control position toward downstream of the vibration control position. Accordingly, the vibration/displacement of the refrigerant line on one side of the vibration control position generally is not transmitted to the other side of the vibration control position, e.g., downstream. The method can also include providing a vibration damping position on the refrigerant line. The vibration damping position may be positioned between a source of the vibration (e.g., a compressor) and the vibration control position. The vibration damping position can be configured to generally absorb or damp the vibration/displacement of the refrigerant line. For example, the vibration reduction position can include a vibration-damping member to damp the vibration/displacement of the refrigerant. In some embodiments, the vibration control position can provide a reference point for determining a position of the vibration damping position on the refrigerant line. The distance between the vibration control position and the vibration damping position can be configured to shift a resonance frequency of the refrigerant line.

In some embodiments, when the refrigerant line is relatively long, a plurality of vibration control positions and/or vibration damping positions can be positioned along the refrigerant line. The first vibration control device and the vibration-damping device may be positioned relative to the compressor to prevent/reduce vibrations from the compressor being transmitted to downstream of the first vibration control device with the method described above. The second vibration control device and the second vibration-damping device may be placed and located relative to the first vibration control device in a similar manner as referencing the placement of the first vibration control device and locate the first vibration-damping device relative to the compressor.

In some embodiments, the vibration-damping device can include a relatively flexible section in the refrigerant line.

In some embodiments, a vibration control device (or position) can be positioned about a location along the refrigerant line that would have a relatively large displacement caused by the vibration without the vibration control device. The location that has a relatively large displacement can be determined, for example, in a laboratory setting. In some embodiments, the vibration control device (or position) can be positioned relatively close to a bend of the refrigerant line.

In some embodiments, a vibration control device (or position) and a vibration-damping device (or position) can be positioned in the same relatively straight portion of the refrigerant line. The relatively straight portion of the refrigerant line can have two opposite ends. The vibration control device (or position) and the vibration-damping device (or position) can be positioned relatively close to the opposite ends respectively. For example, in some embodiments, the relatively straight portion of the refrigerant line can be defined by a first bend and a second bend of the refrigerant line. The vibration-damping device (or position) can be positioned close to the first bend and the vibration control device (or position) can be positioned close to the second bend. It is to be appreciated that the refrigerant line between the vibration control device and the vibration-damping device can be curved or have one or more bends.

The embodiments as disclosed herein can also be used to retrofit an existing HVAC system. The embodiments as disclosed herein can also be applied to other systems such as a refrigeration system, or a fluid pumping system. Generally, the embodiments as disclosed herein can be applied to a line in any device that may be prone to damage caused by, for example, vibration. The line can be more prone to damage caused by vibration, when the resonance frequency of the line is close to the frequency of the vibration. The embodiments as disclosed herein can help reduce/prevent damage to the line caused by the vibration.

FIG. 1 illustrates an HVAC system 100 with which embodiments as disclosed herein may be practiced. The HVAC system 100 includes a compressor 110 and a condenser coil 120. The compressor 110 and the condenser coil 120 are connected by a refrigerant line 115. The refrigerant line 115 may be attached to a frame 130 of the HVAC system 100 by a vibration control device 116 (e.g., a clamp, etc.).

In operation, the compressor 110 may produce vibration. The vibration can be transmitted to the refrigerant line 115 and cause displacement of the refrigerant line 115. When a frequency of the vibration produced by the compressor 110 is at or about a resonance frequency of the refrigerant line 115, the refrigerant line 115 may be excited by the vibration of the compressor 110, causing a relatively large displacement that may damage (e.g., cause line breakage, etc.) the refrigerant line 115. In some embodiments, when the resonance frequency of the refrigerant line 115 may be at or about 20 Hz to at or about 100 Hz, the resonance of the refrigerant line 115 may be relatively close to the frequency of the compressor vibration making the refrigerant line 115 relatively prone to vibration caused damage. In some embodiments, the displacement of the refrigerant line 115 caused by the vibration may be at or about 100 to at or about 200 thousandths of an inch. It is to be appreciated that these ranges are exemplary and that the values can vary beyond the stated range.

Figure 2B:
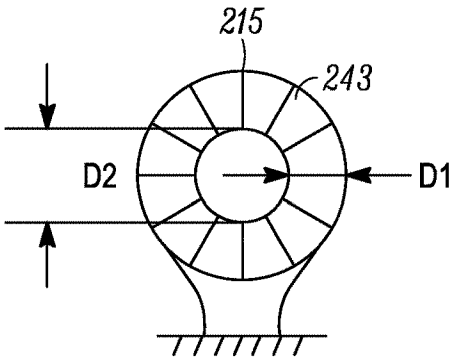
FIGS. 2A and 2B illustrate one embodiment directed to reduce vibration so as to, for example, reduce damage to a refrigerant line of an HVAC system.
Figure 2A:
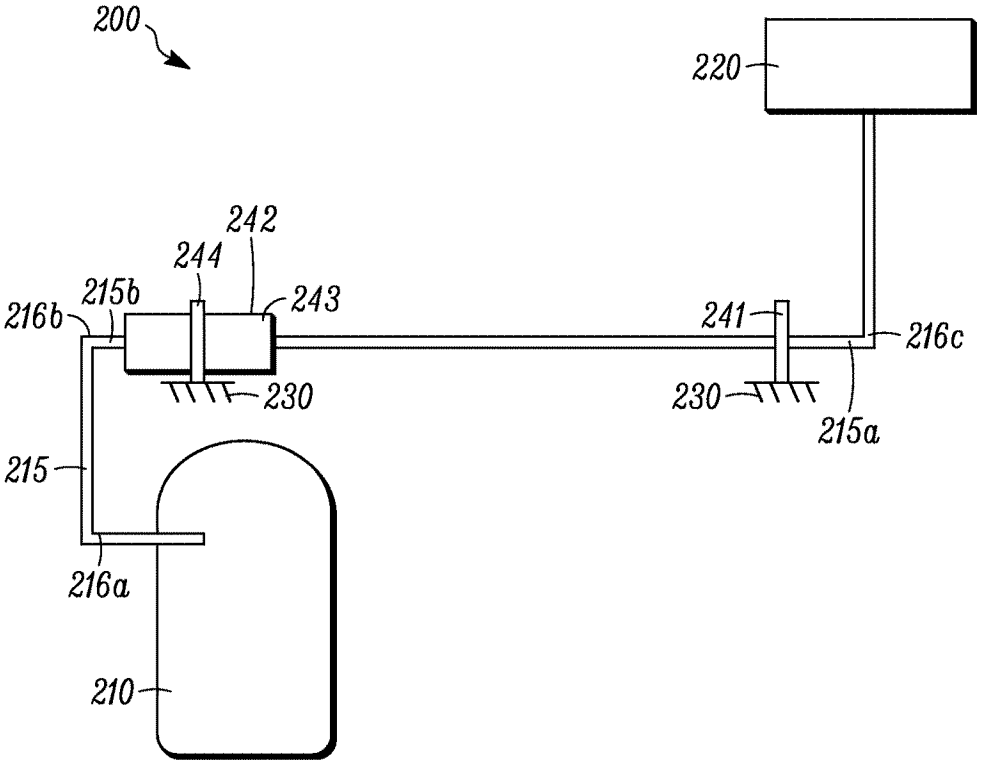

FIG. 2A illustrates an HVAC system 200 that is configured to help isolate/damp vibration produced by a vibration source such as, for example, a compressor 210, along a refrigerant line 215, according to some embodiments. The compressor 210 is connected to a condenser coil 220 by the refrigerant line 215.

The refrigerant line 215 can be attached to a frame 230 of the HVAC system 200 via a vibration control device 241. The vibration control device 241 may include, for example, a clamp. The vibration control device 241 may be generally configured to help prevent vibration produced by the vibration source (e.g., the compressor, etc.), for example, from being transmitted across the vibration control device 241 along the refrigerant line 215 to downstream of the vibration control device 241. In some embodiments, the vibration control device 241 may be relatively rigid compared to the refrigerant line 215. The relatively rigid vibration control device 241 can help isolate the vibration produced by the compressor 210 from a portion of the refrigerant line 215 located upstream of the vibration control device 241, or other components of the HVAC system 200 located upstream of the vibration control device 241. By using the vibration control device 241, the vibration produced by the compressor 210 may mainly affect a portion of the refrigerant line 215 between the vibration control device 241 and the compressor 210, and help prevent the vibration from being transmitted, for example, to downstream of the vibration control device 241 along the refrigerant line 215. A rigid material or structure may be a heavy material, a wall structure, or an HVAC system frame.

It is to be appreciated that the vibration control device 241 may be generally attached to a relatively rigid structure, such as for example, the frame 230 in the illustrated embodiments. In some embodiments, the vibration control device 241 may be attached to other relative structures, such as for example, a wall, or the like.

The location of the vibration control device 241 along the refrigerant line 215 may be varied or optimized. As illustrated in FIG. 2A, the refrigerant line 215 may have one or more bends, 216*a*, 216*b*, 216*c*, between the compressor 210 and the condenser coil 220. The plurality of bends 216*a*, 216*b*, 216*c* may help, for example, prevent/reduce refrigerant line breakage during the shipment of the HVAC system 200. In some embodiments, the vibration control device 241 may be positioned relatively close to the last bend 216*c* before the refrigerant line reaches the condenser coil 220. In some embodiments, the vibration control device 241 may be positioned upstream of the last bend 216*c*. In some embodiments, the vibration control device 241 may be positioned at least two bends (e.g., 216*a*, 216*b*) away from the compressor 210. In some embodiments, particularly when the refrigerant line 215 between the compressor 210 and the condenser 220 is relatively long, more than one vibration control device 241 may be positioned along the refrigerant line 215.

A vibration-damping device 242 is configured to engage the refrigerant line 215 between the vibration control device 241 and the compressor 210. The vibration-damping device 242 may generally be configured to absorb or damp the vibration/displacement of the refrigerant line 215. In the illustrated embodiment, the vibration-damping device 242 may include a damping member 243 and a holding device 244 (e.g., a clamp, etc.). The holding device 244 generally can help keep the damping member 243 on the refrigerant line 215.

As illustrated in FIG. 2A, the vibration-damping device 242 may be positioned relatively closer to the compressor 210 than the vibration control device 241. In some embodiments, the vibration-damping device 242 may be positioned at about a location that has a relatively large displacement between the compressor 210 and the vibration control device 241. The location of the refrigerant line 215 having a relatively large displacement may be determined, for example, in a laboratory setting (e.g., a laboratory vibration qualification testing, etc.). For example, the HVAC system 200 may be put in operation in a lab. The vibration control device 241 may be used to hold the refrigerant line 215. The displacement of the refrigerant line 215 may be evaluated to find the location that may have relatively large displacement when the compressor 210 is in operation.

In some embodiments, the vibration-damping device 242 may be placed some distance away from the compressor 210 so as to allow some flexibility for compressor movement during operation. In some embodiments, the vibration-damping device 242 may be placed at least one bend away from the compressor 210. In some embodiments, the vibration-damping device 242 may be positioned close to the bends 216*a*, 216*b*, 216*c* that are relatively away from the compressor 210 or close to the vibration control device 241.

As illustrated in FIG. 2B, the damping member 243 is configured to contact the refrigerant line 215. The damping member 243 can generally absorb vibration energy, and may include a vibration damping material, such as for example, memory foam, hyper elastic foam, cellular polyurethane, or other viscoelastic materials. In some embodiments, the damping member 243 can wrap around a portion of the refrigerant line 215. In some embodiments, the displacement of the refrigerant line 215 can result in at or about 3-20% compression of the damping member 243 along a thickness D1 of the damping member 243 in operation. In some embodiments, the damping member 243 may also be configured to resist the temperature of the refrigerant line 215 during operation.

The damping member 243 has the thickness D1 and the refrigerant line 215 has a diameter D2. In some embodiments, the thickness D1 is about one to two times of the diameter D2. In some embodiments, as illustrated in FIG. 2A, the damping member 243 can be positioned at the same relatively straight portion of the refrigerant line 215 as the vibration control device 241. In some embodiments, the vibration control device 241 and the vibration-damping device 242 can be positioned closer to a first end 215*a* than to a second end 215*b* of the relatively straight portion of the refrigerant line 215.

Referring back to FIG. 2A, the damping member 243 can be configured to cover a portion of the refrigerant line 215. In some embodiments, as shown in FIG. 2A, the covered portion of the refrigerant line 215 by the damping member 243 may be smaller than about 50% of a length of the refrigerant line 215 between the two bends 216*b* and 216*c*. In some embodiments, the covered portion of the refrigerant line 215 may be smaller than about 20% of the length of the refrigerant line 215 between the two bends 216*b* and 216*c*. In some embodiments, the length of the covered portion of the refrigerant line 215 may be at least the diameter D2 of the refrigerant line 215. It is noted that as the damping member 243 moves closer to the location of the highest displacement during operation, the damping effect of the damping member 243 may increase.

In the illustrated embodiment, the bend 216*b*, which is one bend (e.g., the bend 216*a*) away from the compressor 210, may be a desired location to place at least one vibration-damping device 242. Because the length of the refrigerant line 215 between the compressor 210 and the bend 216*b* is relatively long, displacement at the bend 216*b* may be relatively large during operation. In some embodiments, due to, for example, a design challenge (e.g., space constraints, etc.), the vibration-damping device 242 may be positioned relatively close to the bend 216*b* between the bend 216*a* and the bend 216*b*. In other embodiments, the vibration-damping device 242 may be positioned relatively close to the bend 216*b* between the bend 216*b* and the vibration control device 241.

Figure 3:
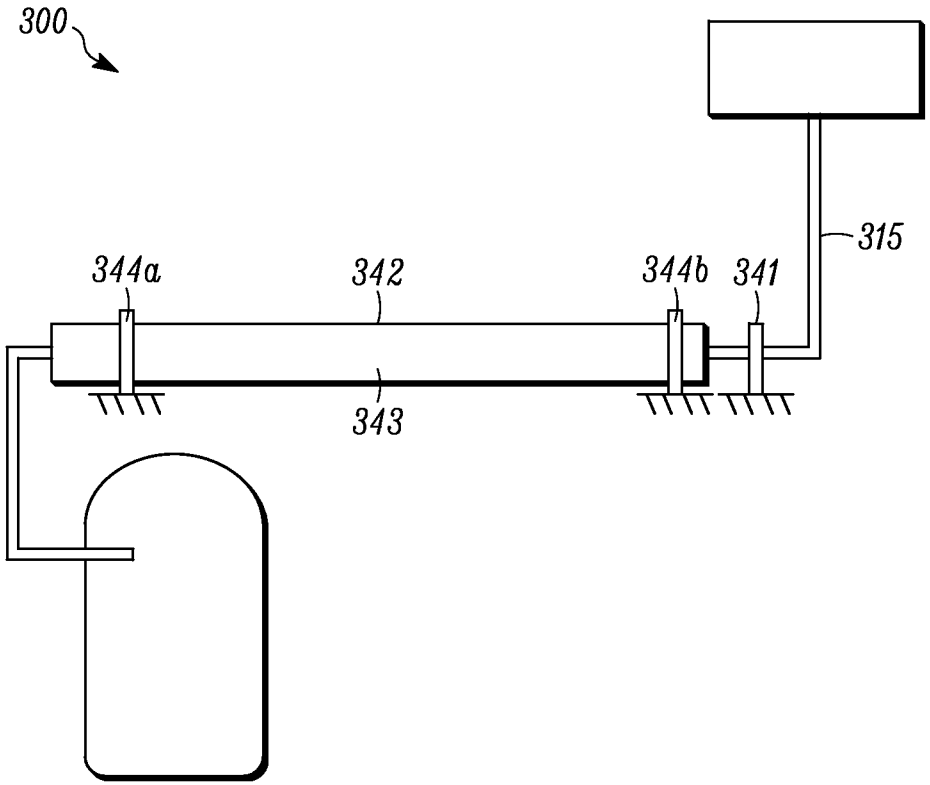
FIG. 3 illustrates another embodiment directed to reduce vibration so as to, for example, reduce damage to a refrigerant line in an HVAC system.

As illustrated in FIG. 3, which illustrates another HVAC system 300, a vibration-damping device 342 may be positioned on the same relatively straight portion of a refrigerant line 315 as a vibration control device 341 and cover a relatively large portion of the refrigerant line 315. The vibration-damping device 342 may include a relatively long damping member 343 and one or more holding devices 344*a*, 344*b*. Because the damping member 343 is relatively long, one or more holding device 344*a*, 344*b* can help keep the damping member 343 on the refrigerant line 315.

Figure 4:
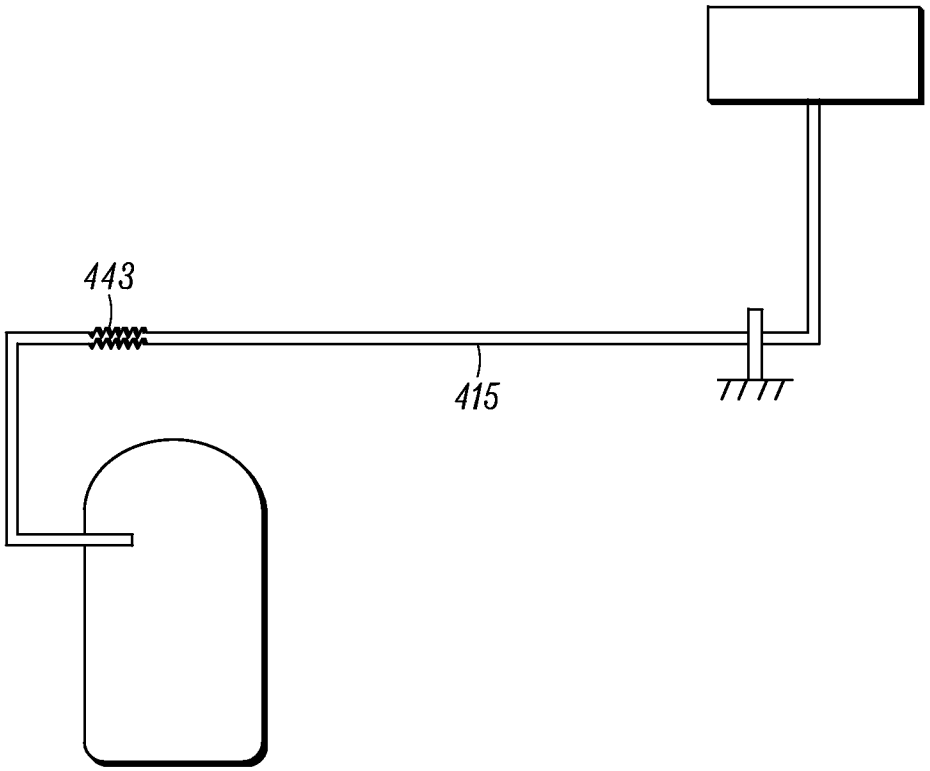
FIG. 4 illustrates yet another embodiment directed to reduce vibration to a refrigerant line in an HVAC system.

As illustrated in FIG. 4, a vibration-damping device 443 can include a section of a refrigerant line 415 that is relatively flexible. As illustrated in FIG. 4, the vibration-damping device 443 can include a bellow-like structure. The relatively flexible section of the vibration-damping device 443 can help absorb or damp the vibration/displacement of the refrigerant line 415 when the vibration passes therethrough.

Aspects:

Any of aspects 1-3 can be combined with any of aspects 4-8. Any of aspects 4-7 can be combined with aspect 8.

Aspect 1. A device to damp vibration of a refrigerant line comprising:

a vibration control device that is configured to engage the refrigerant line; and a vibration-damping device that is configured to engage the refrigerant line, the vibration-damping device positioned between a vibration source and the vibration control device;

wherein the vibration-damping device includes: a damping member and a holding device, the damping member is configured to engage the refrigerant line, and the holding device is configured to keep the damping member on the refrigerant line.

Aspect 2. The device of aspect 1, wherein the vibration control device is rigid relative to the refrigerant line so as to prevent vibration from being transmitted across the vibration control device.

Aspect 3. The device of any of aspects 1-2, wherein the vibration source is a compressor of an HVAC system.

Aspect 4. An HVAC system, comprising:

a compressor, a refrigerant line connected to the compressor;

a vibration control device that is configured to engage the refrigerant line; and a vibration-damping device that is configured to engage the refrigerant line, the vibration-damping device positioned between the compressor and the vibration control device;

wherein the vibration-damping device include: a damping member and a holding device, the damping member is configured to engage the refrigerant line, and the holding device is configured to keep the damping member on the refrigerant line.

Aspect 5. The HVAC system of aspect 4, further comprising:

a condenser coil;

wherein the refrigerant line between the compressor and the condenser coil has a plurality of bends, and the vibration control device is positioned one bend away from the condenser coil.

Aspect 6. The HVAC system of any of aspects 4-5, wherein the vibration-damping device is at least one bend away from the compressor.

Aspect 7. The HVAC system of any of aspects 4-6, wherein the vibration control device is rigid relative to the refrigerant line so as to prevent vibration from being transmitted across the vibration control device.

Aspect 8. A method of damping vibration of a refrigerant line comprising:

providing a vibration control position on the refrigerant line; and providing a vibration damping position on the refrigerant line, the vibration damping position configured to be between a vibration source and the vibration control position.

The terminology used in this specification is intended to describe particular embodiments and is not intended to be limiting. The terms "a," "an," and "the" include the plural forms as well, unless clearly indicated otherwise. The terms "comprises" and/or "comprising," when used in this Specification, specify the presence of the stated features, integers, steps, operations, elements, and/or components, but do not preclude the presence or addition of one or more other features, integers, steps, operations, elements, and/or components.

With regard to the preceding description, it is to be understood that changes may be made in detail, especially in matters of the construction materials employed and the shape, size, and arrangement of parts without departing from the scope of the present disclosure. This specification and the embodiments described are exemplary only, with the true scope and spirit of the disclosure being indicated by the claims that follow.

What is claimed is:

1. A heating, ventilation, and air conditioning (HVAC) system, comprising:

a compressor, a refrigerant line connected to the compressor;

a condenser coil, the refrigerant line being between the compressor and the condenser coil and having a plurality of bends forming a plurality of portions of the refrigerant line;

a vibration control device that is configured to engage the refrigerant line and be secured to a frame of the HVAC system; and a vibration-damping device that is configured to engage the refrigerant line and be secured to a frame of the HVAC system, the vibration-damping device positioned between the compressor and the vibration control device at a location having a displacement between the compressor and the vibration control device that is larger than a displacement at a location other than between the compressor and the vibration control device, wherein the vibration-damping device includes:

a damping member and a holding device, the damping member is configured to engage the refrigerant line, and the holding device is configured to keep the damping member on the refrigerant line, and wherein the vibration-damping device and the vibration control device are disposed on a first of the plurality of portions of the refrigerant line, the first of the plurality of portions of the refrigerant line being longer than others of the plurality of portions of the refrigerant line, the others of the plurality of portions of the refrigerant line being closer to the compressor than the first of the plurality of portions of the refrigerant line.

2. The HVAC system according to claim 1, wherein the vibration control device is positioned one bend away from the condenser coil.

3. The HVAC system according to claim 2, further comprising:

a second vibration control device disposed between the vibration control device and the condenser coil.

4. The HVAC system according to claim 1, wherein the vibration-damping device is positioned at least one bend away from the compressor.

5. The HVAC system according to claim 1, wherein the vibration control device is rigid relative to the refrigerant line so as to prevent vibration from being transmitted across the vibration control device.

6. The HVAC system according to claim 1, wherein a length of the damping member along the refrigerant line is greater than a diameter of the refrigerant line.

7. The HVAC system according to claim 1, wherein a thickness of the damping member is from 1 to 2 times greater than a diameter of the refrigerant line.

8. The HVAC system according to claim 1, wherein the damping member includes a vibration damping material, and the vibration damping material includes one or more of a memory foam, a hyper elastic foam, a cellular polyurethane, and a viscoelastic material; and the vibration damping material is selected to be compressed by the refrigerant line from 3 to 20% in a thickness direction of the damping member in operation.

9. The system according to claim 1, wherein the vibration-damping device includes a damping member and a plurality of holding devices, each of the plurality of holding devices being configured to be secured to the frame of the HVAC system.

10. A method of damping vibration of a refrigerant line in a heating, ventilation, and air conditioning (HVAC) system, the method comprising:

providing a vibration control position on the refrigerant line;

securing a vibration control device to the refrigerant line and a frame of the HVAC system at the vibration control position;

providing a vibration damping position on the refrigerant line, the vibration damping position configured to be between a vibration source and the vibration control position;

disposing a vibration-damping device at the vibration damping position, the vibration damping position being between the vibration source and the vibration control position at a location having a displacement between the vibration source and the vibration control position that is larger than a displacement at a location other than between the vibration source and the vibration control position; and securing the vibration-damping device to the refrigerant line and the frame of the HVAC system at the vibration damping wherein the HVAC system includes a condenser coil, the refrigerant line being between the vibration source and the condenser coil and having a plurality of bends forming a plurality of portions of the refrigerant line; and wherein the vibration-damping device and the vibration control device are disposed on a first of the plurality of portions of the refrigerant line, the first of the plurality of portions of the refrigerant line being longer than others of the plurality of portions of the refrigerant line, the others of the plurality of portions of the refrigerant line being closer to the vibration source than the first of the plurality of portions of the refrigerant line.

11. The method according to claim 10, wherein the vibration control position is a reference point for determining the vibration damping position.

12. The method according to claim 10, wherein a distance between the vibration control position and the vibration damping position is selected to shift a resonance frequency of the refrigerant line.

* * * * *